US009968825B2

(12) United States Patent
Snyder

(10) Patent No.: US 9,968,825 B2
(45) Date of Patent: May 15, 2018

(54) CORE EXERCISING MACHINE

(71) Applicant: Michael J Snyder, Newport Beach, CA (US)

(72) Inventor: Michael J Snyder, Newport Beach, CA (US)

( * ) Notice: Subject to any disclaimer, the term of this patent is extended or adjusted under 35 U.S.C. 154(b) by 0 days. days.

(21) Appl. No.: 15/161,811

(22) Filed: May 23, 2016

(65) Prior Publication Data

US 2017/0021225 A1 Jan. 26, 2017

Related U.S. Application Data

(63) Continuation of application No. 14/229,772, filed on Mar. 28, 2014, now abandoned.
(Continued)

(51) Int. Cl.
*A63B 23/02* (2006.01)
*A63B 21/00* (2006.01)
*A63B 21/008* (2006.01)

(52) U.S. Cl.
CPC .... *A63B 23/0205* (2013.01); *A63B 21/00069* (2013.01); *A63B 21/00072* (2013.01);
(Continued)

(58) Field of Classification Search
CPC ..... A63B 23/0205; A63B 23/0211; A63B 23/0216; A63B 23/0222; A63B 23/0227
See application file for complete search history.

(56) References Cited

U.S. PATENT DOCUMENTS 4,684,125 A 8/1987 Lantz
5,071,119 A 12/1991 Johnson
(Continued)

FOREIGN PATENT DOCUMENTS

WO 2006008766 1/2006
WO 2009040808 4/2009

OTHER PUBLICATIONS

Keiser Air 250 Abdominal machine, webprints and parts diagram, Aug. 31, 2012.
Keiser Air 250 Lower Back machine, webprint and parts diagram, Aug. 31, 2012.
Transform 12 Exercise Fitness System, wepprint, Aug. 31, 2012.

*Primary Examiner* — Loan H Thanh
*Assistant Examiner* — Rae Fischer
(74) *Attorney, Agent, or Firm* — Guy Cumberbatch

(57) ABSTRACT

A collapsible exercise machine for strengthening the core muscles (transverse abdominal, internal obliques, external obliques, rectus abdominis, and erector spinae) includes a frame mounted on a base on which a user sits and manipulates an upstanding lever arm. A seat is convertible between two differently-angled positions for back extension or abdominal exercises. The lever arm rotates a curved tube having a plurality of force adjustment holes. The tube passes through a frame at the upper end of a gas spring, and engaging an adjustment pin on the frame with different adjustment holes changes the amount of resistance. The entire frame above the base can be vertically adjusted to accommodate different sizes of user without altering the relative position between the seat (and user's hips) and the axis of rotation of the lever arm thus not affecting/changing the designated resistance between users of different heights (resistance is affected when the lever arm is lengthened). The connection between the frame and the base enables the unit to be collapsed to a profile small enough to fit under a bed.

6 Claims, 14 Drawing Sheets

Related U.S. Application Data

(60) Provisional application No. 61/806,319, filed on Mar. 28, 2013.

(52) U.S. Cl.
CPC ..... *A63B 21/0083* (2013.01); *A63B 21/0087* (2013.01); *A63B 21/4033* (2015.10); *A63B 21/4047* (2015.10); *A63B 23/0211* (2013.01); *A63B 23/0233* (2013.01); *A63B 2208/0233* (2013.01); *A63B 2210/50* (2013.01); *A63B 2225/09* (2013.01)

(56) References Cited

U.S. PATENT DOCUMENTS

| | | | | |
|---|---|---|---|---|
| 5,104,121 | A | 4/1992 | Webb | |
| 5,256,126 | A | 10/1993 | Grotstein | |
| 5,391,132 | A * | 2/1995 | Greenwald | A63B 23/03533 482/114 |
| 5,603,681 | A | 2/1997 | Olschansky | |
| D379,483 | S | 5/1997 | England | |
| 6,354,982 | B1 | 5/2002 | Sencil | |
| 6,387,024 | B1 | 5/2002 | Monti | |
| 6,746,384 | B2 | 6/2004 | Cole | |
| 6,932,749 | B2 * | 8/2005 | Barnes | A63B 21/00072 482/130 |
| 7,374,518 | B2 * | 5/2008 | Ratner | A63B 21/0552 482/111 |
| 7,806,813 | B2 | 10/2010 | Campitelli | |
| 7,806,815 | B2 | 10/2010 | Fernandex | |
| 2002/0151419 | A1 | 10/2002 | Barnes et al. | |
| 2005/0101464 | A1 | 5/2005 | Campitelli | |
| 2007/0287619 | A1 * | 12/2007 | Tuller | A63B 21/4047 482/140 |

* cited by examiner 20
52
50
54
44
46
48
43
42
54
100
40
C/L
94
86
90
88
22
84
82
32
28
24
26
92
95
30
34

40
102
60
80
72
76
66
82
62
64
22
74
70
68

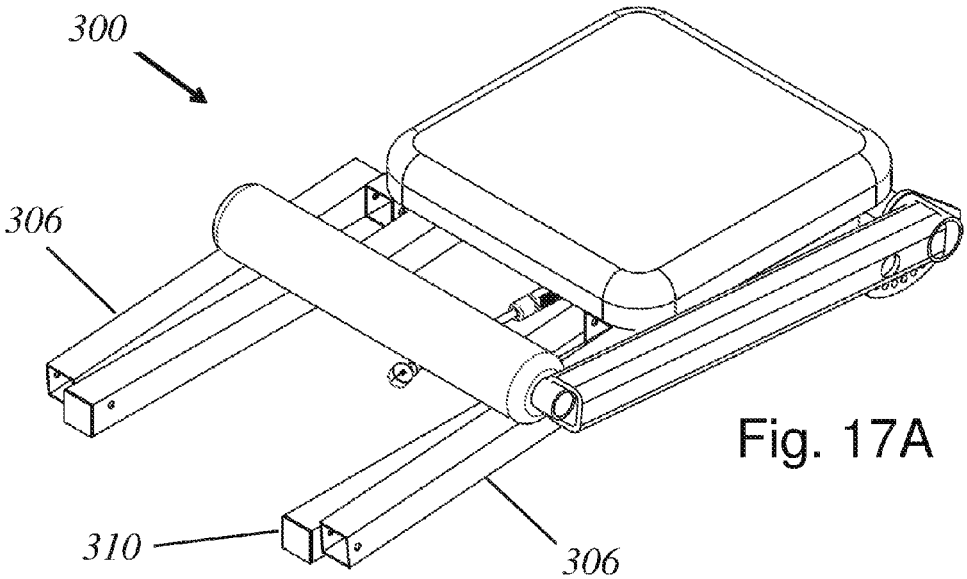
Fig. 17A
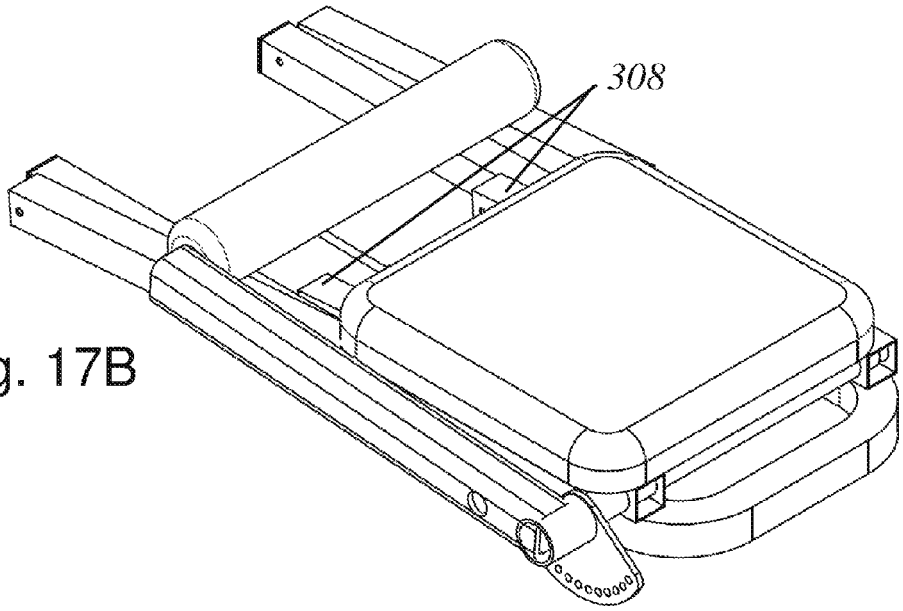
Fig. 17B
Fig. 17C
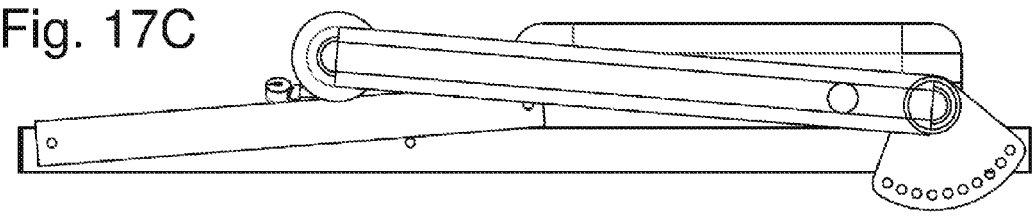

CORE EXERCISING MACHINE

RELATED APPLICATION

The present application is a continuation of U.S. application Ser. No. 14/229,772, filed Mar. 28, 2014, which claims priority under 35 U.S.C. § 119 to U.S. Provisional Application Ser. No. 61/806,319, filed Mar. 28, 2013.

FIELD OF THE INVENTION

The present invention is directed to a collapsible resistance-based machine for exercising the core muscles of the body.

BACKGROUND OF THE INVENTION

With widespread awareness of its significant health benefits, regular exercise including progressive resistance strength training has become a matter of high priority to many members of the general public. Progressive resistance strength training is a type of strength training that uses free weights, exercise weight stack machines, compressed air (pneumatics), hydraulic resistance, elastic/rubber bands and gas springs as resistance to strengthen muscles. The key to this type of exercise is adjusting the resistance as the person progresses. A major obstacle faced by most in following a progressive resistance strength training program is the lack of readily accessible equipment that enable them to exercise different portions of the body at home. Ideally, an in-home gym facility is equipped with various exercise machines and implements for exercising different portions of the body but most do not.

The most difficult and overlooked muscles to exercise at home with progressive resistance are the muscles of the core (transverse abdominal, internal obliques, external obliques, rectus abdominis and erector spinae). These muscles are antagonistic in that they oppose the movement of one another. Proper strength and tone of each muscle group is important for proper posture, reduction of back injuries and physical health. Despite the importance of the abdominal, and lower back muscles, these muscles tend to be forgotten in most home exercise gyms. Consequently, there is a need for a core exercise machine that uses progressive resistance, is compact, portable, affordable, and easy to use.

Versatile machines that are reconfigurable to enable various exercises do exist. Those machines, however, typically include complex arrangements of mechanical parts and require complicated series of adjustments to reconfigure the machine for different exercises. Where such complexity is not present, the machines are either undesirably limiting in the number of different exercises that may be performed on them, don't allow for any significant resistance, don't offer a wide range of resistance or are physically of such substantial mass and dimensional extent that they may be fully utilized only in certain wide-open areas of a given home, and are hardly movable, let alone portable. Preferably, an in-home machine with such versatility offers a broad range of progressive resistance, is safe, easy to use, affordable, light weight, and collapsible for storage.

Known exercise machines provide weights or a reaction force as a source of resistance (weights are heavy and expensive). Rubber elements used as stretchable resistance bands have been widely used to oppose motion of certain mechanisms in an exercise machine (the problem with a stretchable band is that the resistance greatly increases as the band stretches and they tend to dry out and break). Gas springs are known as well which have a piston/cylinder arrangement. Gas inside the cylinder flows through or around the piston from one side to the other as it moves back and forth in various designs; usually the piston has one or more holes or valves in it. The whole cylinder is completely sealed, and when the piston rod is inside the cylinder, it takes up room that the gas previously occupied. In other words, when a gas spring is fully pushed in, the gas inside compresses by an amount equal to the volume of the piston rod. Furthermore, the net force on the piston is out of the cylinder because the piston rod within the cylinder takes up space and thus there is a pressure differential across the piston. For instance, a gas spring in U.S. Patent Publication No. 2005/0101464 provides a resistance force which increases somewhat during compression. Typically, Nitrogen is the working gas inside the gas spring.

Despite numerous exercise machines on the market, there remains a need for a portable machine that works the core muscles of the body, that can supply similar resistance to weights yet be safer, portable, moveable, affordable, and which can easily be adjusted for different exercises and users.

SUMMARY OF THE INVENTION

The present application provides an exercise machine for strengthening the core muscles of the body, which consists mostly of the abdominal (transverse abdominal, internal obliques, external obliques, and rectus abdominis) and erector spinae muscles of the back. The machine has a relatively elongated base, and is shaped like an upside down "T" (with the base as the top of the "T"). The machine is collapsible for storage under a bed and shipping. The angle of the top vertical bar can be adjusted forward and backward by the user. The top vertical bar can be adjusted to different angles to target the various muscles of the core, to safely limit flexion or extension if needed to avoid discomfort, and it allows for a slimmer profile when collapsing the unit so that it can be stored under a bed or shipped. The top vertical bar can also be adjusted to properly isolate the desired muscles for a given exercise or limit range of motion to avoid a painful position for the user. The height of the vertical bar can be adjusted to the height of the user's torso. There may also be a foot rest so that the height can be adjusted to match the user's leg length.

In accordance with one preferred embodiment, an exercise machine comprises a base having at least one upstanding leg at the top of which is a housing within which a horizontal bar rotates, the housing having a seat firmly mounted thereon such a user can sit on the seat with his or her legs on the ground or on the base. An upstanding lever arm attaches to an end of the horizontal bar displaced from the housing and terminates in a horizontal force application bar. A user sitting in the seat can manipulate the force application bar and rotate the horizontal bar within the housing. A source of adjustable resistance is coupled to rotation of the horizontal bar, and an adjustable indexing device connects to the upstanding lever arm for changing the rotational orientation of the lever arm relative to the horizontal bar. Preferably, the leg and lever arm may be rotated with respect to the base to allow them to lie substantially flat.

Another exercise machine in accordance with the application includes a base having at least one upstanding leg at the top of which is a housing within which a horizontal bar rotates. The housing has a seat firmly mounted thereon such a user can sit on the seat with his or her legs on the ground or on the base. An upstanding lever arm attaches to an end of the horizontal bar displaced from the housing terminates in a horizontal force application bar. A user sitting in the seat can manipulate the force application bar and rotate the horizontal bar within the housing. A source of adjustable resistance is coupled to rotation of the horizontal bar. A height adjustment mechanism between the at least one upstanding leg and the base permits the upstanding leg to be raised relative to the base and changes the height of the seat without altering the spacing between the seat and the axis of rotation of the horizontal bar. Preferably, the leg and lever arm may be rotated with respect to the base to allow them to lie substantially flat. By not having to raise the seat height for taller users the hips can be maintained close to the C/L of rotation of the lever arm thus mimicking the body's natural biomechanics which improves safety and isolates the desired muscle groups. In addition, by raising the vertical bar to adjust the height it minimizes the amount you have to raise the lever arm for taller users, which would otherwise lessen the overall resistance.

A further exemplary exercise machine again has at least one upstanding leg at the top of which is a housing within which a horizontal bar rotates. The housing has a seat firmly mounted thereon such a user can sit on the seat with his or her legs on the ground or on the base. An upstanding lever arm attaches to an end of the horizontal bar displaced from the housing terminates in a horizontal force application bar. A user sitting in the seat can manipulate the force application bar and rotate the horizontal bar within the housing. A source of adjustable resistance is coupled to rotation of the horizontal bar, wherein the seat position can be changed relative to the upstanding leg, and wherein in one position the seat is horizontal and positioned for a user to perform abdominal exercises, and wherein in the other position the seat is angled from the horizontal in position for a user to perform back extension exercises. Preferably, the leg and lever arm may be rotated with respect to the base to allow them to lie substantially flat. The seat preferably has two downwardly extending tubes, wherein the seat position can be changed by engaging one or the other of the downwardly extending tubes with an upstanding post on the housing.

A still further collapsible exercise machine has at least one upstanding leg at the top of which is a housing within which a horizontal bar rotates. The housing has a seat firmly mounted thereon such a user can sit on the seat with his or her legs on the ground or on the base. An upstanding lever arm attaches to an end of the horizontal bar displaced from the housing terminates in a horizontal force application bar. A source of adjustable resistance couples to rotation of the horizontal bar, and connections between the components of the exercise machine which permit it to be collapsed down to a maximum height of 8 inches.

Another exercise machine has at least one upstanding leg at the top of which is a housing within which a horizontal bar rotates. The housing has a seat firmly mounted thereon such a user can sit on the seat with his or her legs on the ground or on the base. An upstanding lever arm attaches to an end of the horizontal bar displaced from the housing terminates in a horizontal force application bar. A gas spring connects between a fixed point on the upstanding leg and a force adjustment bar extending from the horizontal bar. The position of an upper end of the gas spring is adjustable along the force adjustment bar, wherein the progressivity of the gas spring is 1.1 or less. Preferably, the leg and lever arm may be rotated with respect to the base to allow them to lie substantially flat.

The machine uses a gas (nitrogen) spring for a constant and consistent resistance force throughout the entire range of motion that is similar to a weight machine. The resistance is variable. The amount of resistance can be adjusted by changing the angle of the gas spring along an arc. If the user sits in one direction on the machine the abdominal muscles can be strengthened and if the user turns around in the other direction the lower back muscles are strengthened. The resistance is easy to switch single-handedly from 10 pounds to 130 pounds, for example, without getting off the machine and having to move dangerous weight plates.

When strengthening the abdominal muscles the user sits so that the arc is between the users legs. The square mounting tube on the bottom of the seat for the abdominals is used. In this position the seat is horizontal and a majority of the seat (e.g., approximately 8", and the seat is 12" long) is in front of the central axis of the lever arm. The user sits so that their hips are in front of the central axis.

When strengthening the muscles of the lower back the user sits so that the arc is behind them. The square mounting tube on the bottom of the seat for the lower back is used. In this position the seat is tilted forward at an angle and a majority of the seat is behind the central axis of the lever arm. The user sits so that their hips are in line with the central axis. The seat is moved from the position in which the abdominals are exercised so that the hips are in line with the central axis.

There is a seat belt attached to the undersurface of the seat to stabilize the thighs and isolate the lower back and abdominal muscles. There are foot rests in front and back of the machine to lock the feet into position. The resistance can be switched single-handedly without getting off the machine and having to move dangerous weight plates.

The exemplary machine provides a portable clinic grade therapeutic exercise device that can be used in a small clinic and also at home. The machine provides progressive resistance training to the abdominal and erector spinae muscles through a gas spring.

The present application provides an advantage over weight stack machines: With weight stack machines momentum and gravity cause sudden acceleration in the load being placed on the joints. This application is safer because it provides a consistent resistance at different speeds without causing unnecessary loading due to gravity and momentum, the machine is space saving, and whereas weights are heavy and noisy, the present machine is relatively lightweight and quiet.

The present application provides an advantage over bands: There is a more linear resistance, a variable resistance, and the machine is safer (bands get dry and crack then suddenly break). Plus, bands only provide consistent resistance in a limited range of motion.

The present application provides an advantage over hydraulic resistance machines in which one can only push or pull so you are not getting the full concentric/eccentric contraction which is essential in strength training.

The present application also provides an advantage over compressed air (pneumatics) which are expensive, need an air compressor, heavy, not portable and take up a lot more space.

The present application, which uses a custom made gas spring also provides an advantage over other gas springs, which don't have a very linear compression factor (the extended force vs. the compressed force) and they have a much lower cycle ability (cycles/minute).

A further understanding of the nature and advantages of the invention will become apparent by reference to the remaining portions of the specification and drawings.

BRIEF DESCRIPTION OF THE DRAWINGS

Features and advantages of the present invention will become appreciated and become better understood with reference to the specification, claims, and appended drawings wherein:

FIG. 1 is a perspective view of an exemplary core exercise machine of the present application, while FIG. 1A is an isolated view of a central horizontal bar thereof;

FIGS. 4A and 4B are enlarged elevational views looking from the side opposite that in FIGS. 3A and 3B and showing two different seat positions for the two different modes, while

FIGS. 17A-17C are several views of the fully collapsed multi-leg exercise machine.

DETAILED DESCRIPTION OF THE PREFERRED EMBODIMENTS

Figures 1, 1A:
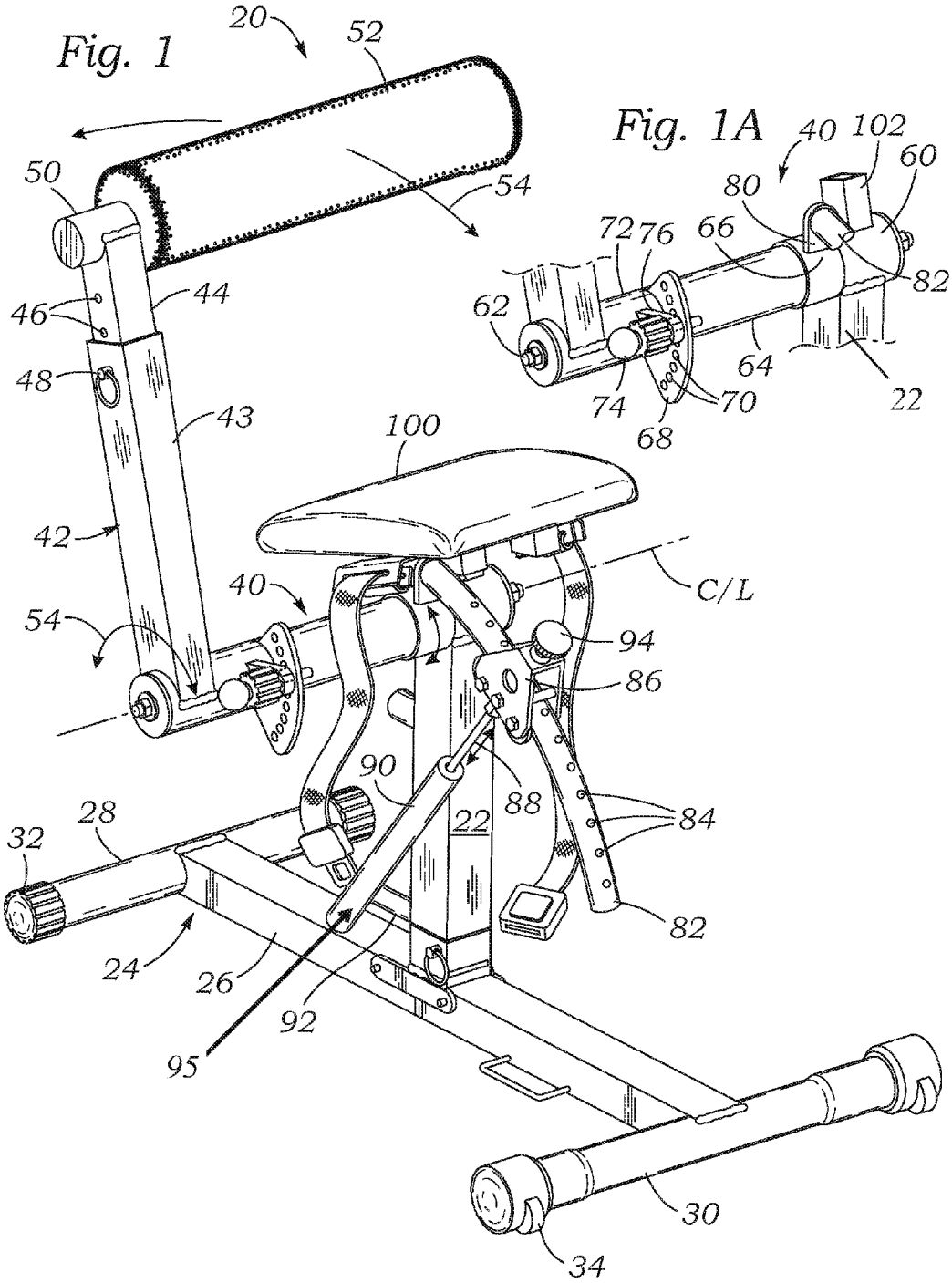

FIG. 1 illustrates an exemplary exercise machine 20 of the present application that includes an upper frame having a generally vertical leg 22 supported on and by a horizontal H-shaped base 24. The base 24 comprises a central longitudinal bar 26 welded at both ends to first and second lateral bars 28, 30. At least one of the lateral bars 28 includes rubber end caps 32 to prevent movement on solid floors, while the other lateral bar 30 desirably has a pair of wheels 34 mounted on each end so that the entire machine 20 can be easily moved.

Figure 2:
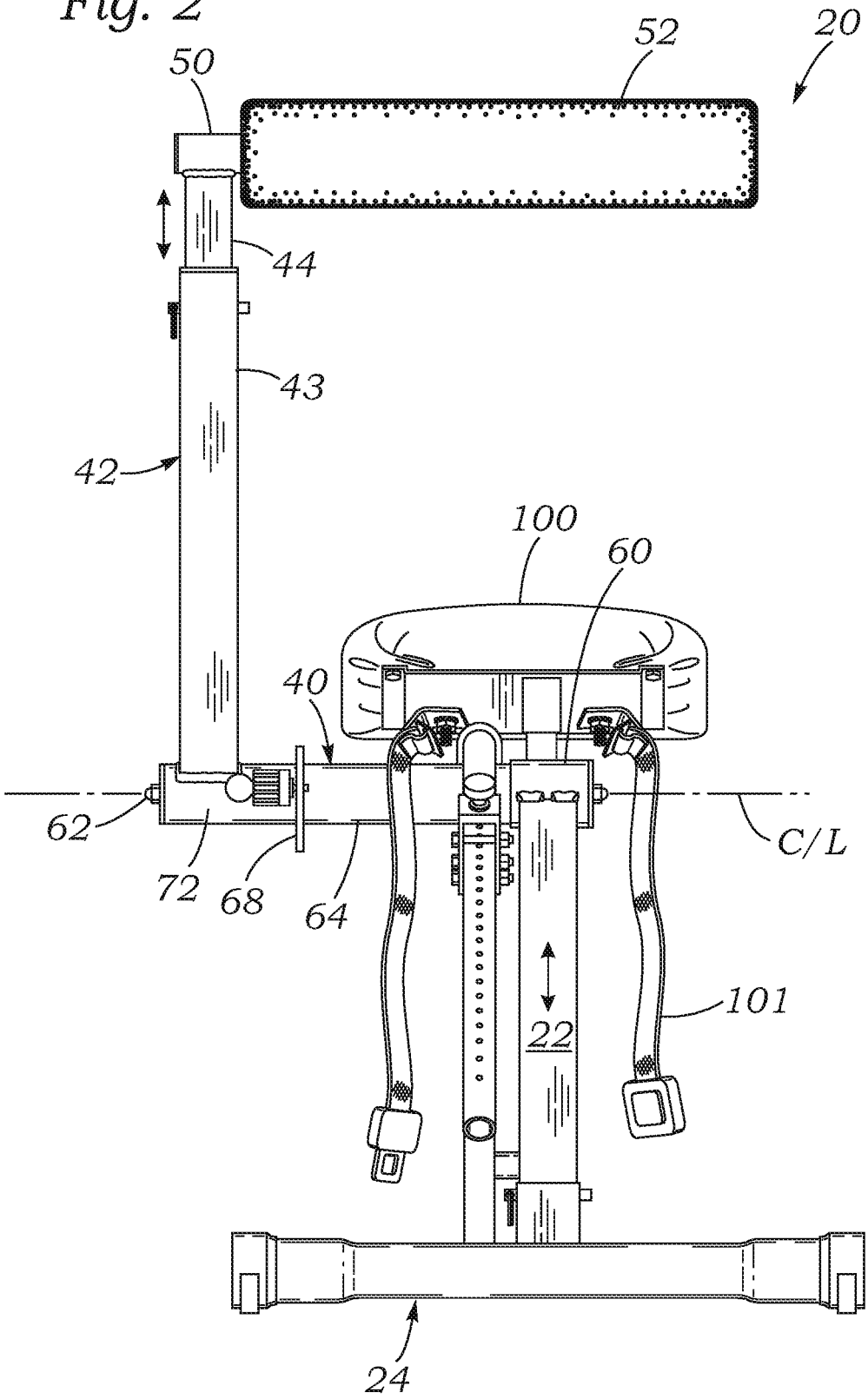
FIG. 2 is an end elevational view of the exercise machine of FIG. 1.

With reference also to FIGS. 1A and 2, the upper frame of the exercise machine 20 features a cylindrical horizontal bar 40 attached at the top of the vertical leg 22 and extending laterally therefrom in one direction. An adjustable lever arm 42 extends upward and comprises a lower section 43 fixed to the horizontal bar 40 and an extendable section 44 movable therein. Preferably, the lever arm 42 and extendable section 44 are square tubes with the latter having a series of spaced holes 46 that can be registered with a spring-loaded length adjustment pin 48 that passes in through a single hole formed in the lever arm 42. A horizontal force application bar 50 preferably covered with a foam pad 52 attaches firmly to the top of the extendable section 44 and extends laterally back over the horizontal bar 40, preferably as far as the vertical leg 22. As shown by the movement arrows 54 in FIG. 1, a user can rotate the force application bar 50 and lever arm 42 about an axis centered along the horizontal bar 40. The center line C/L of the horizontal bar 40 defines the axis of rotation of the lever arm 42.

FIG. 1A isolates the horizontal bar 40 so as to explain the manner in which the force application bar 50 and lever arm 42 rotate about a horizontal axis through the top of the vertical leg 22. First of all, a short tubular fixed housing 60 rigidly attaches (e.g., by welds) at the top of the vertical leg 22 and contains therein bearings or plastic washers that enable rotation of an elongated metal inner sleeve within the horizontal bar 40. Although not shown, the relatively large inner sleeve extends horizontally from one end of the fixed housing 60 through the bearings or plastic washers to the opposite end of the horizontal bar 40, with the elongated structure being secured by end bolts 62. A rotatable tubular central section 64 is rotationally fixed with respect to the inner shaft, as is a short tubular force transmission collar 66 between the central section 64 and the fixed housing 60. The fixed housing 60 and force transmission collar 66 are independent of one another; the housing 60 does not rotate while the force transmission collar 66 does. A wedge-shaped indexing plate 68 fixed rotationally with respect to the central section 64 extends in a radial plane outward therefrom and includes a plurality of adjustment holes 70 formed in an arc oriented about the center line CL. A tubular end section 72 of the horizontal bar 40 is journaled for rotation about the inner shaft but can be fixed with respect thereto by engaging an adjustment pin 74 spring-mounted on a flange 76 with one of the adjustment holes 70 in the indexing plate 68. That is, the entire structure of the horizontal bar 40 rotates within the fixed housing 60 with the angle of the lever arm 42 relative to the central section 64 being adjustable by virtue of the pin 74 and holes 70.

With the reference still to FIGS. 1 and 1A, an upstanding flange 80 welded to the force transmission collar 66 provides a fastening point for an elongated curved tubular bar 82. The bar 82 has a series of evenly spaced force adjustment holes 84 on an upper generatrix. The bar 82 passes through a bracket 86 mounted on the top end of a rod 88. As seen best in FIG. 4A, the rod 88 extends downward into a cylinder 90 which is pivotally mounted toward its lower end on a bracket 92 fixed to a lower end of the vertical leg 22. In a preferred embodiment, the rod 88 is desirably positioned below the cylinder 90 so that the internal seal around the rod stays lubricated, such as seen in the alternative embodiment of FIGS. 8-11.

Again with reference to FIG. 1, the upper end of the rod 88 can be fixed with respect to a position along the curved bar 82 by engaging a spring-loaded adjustment pin 94 mounted in the bracket 86 in one of the adjustment holes 84. The rod 88 and cylinder 90 preferably comprise a nitrogen gas spring 95, although other force resistance devices can be utilized. A gas spring supplies a constant force resembling weights. Indeed, the preferred gas spring 95 has a relatively low progressivity of 6-11%, preferably 7-8%, which means that if you start out at 100 lbs of resistance, as the gas spring compresses the resistance goes up to 106-108 lbs of force. Such a gas spring is available from Taizhou Xinda Gas Spring Co., Ltd, although other suppliers are available. Most stock springs have a progressivity of between 20-40%. It should be understood, however, that various features of the exercise machine 20 described herein are useful with a conventional gas spring, or even without including a gas spring, and therefore a spring resistance device or other such mechanism can be substituted.

Also, none of the previous stock gas springs are made for using at more than 6 cycles per minute, while the gas springs disclosed herein can be used up to 18-20 cycles per minute due to the quality of the seals.

When the user rotates the horizontal bar 40, including the force transmission collar 66 and flange 80 as seen in FIG. 1A, the curved bar 82 rotates as well, which alternately moves the rod 88 in and out of the cylinder 90. As explained above, a gas spring 95 provides resistance to movement of the rod 88 in both directions. The user can adjust the resistance significantly (e.g., 10 lbs to about 130 lbs) for use depending on which one of the adjustment holes 84 the adjustment pin 94 engages. That is, the change in lever arm distance from moving the bracket 86 along the curved bar 82 changes the resistance. Generally speaking, the lower down on the curved bar 82 that the upper end of the rod 88 engages the greater the resistance to rotation of the lever arm 42. Vice versa, moving the adjustment pin 94 up on the curved bar 82 toward the centerline C/L reduces the resistance. Optionally, a second gas spring in parallel with or in place of the first may be added to supply more resistance.

Figure 3B:
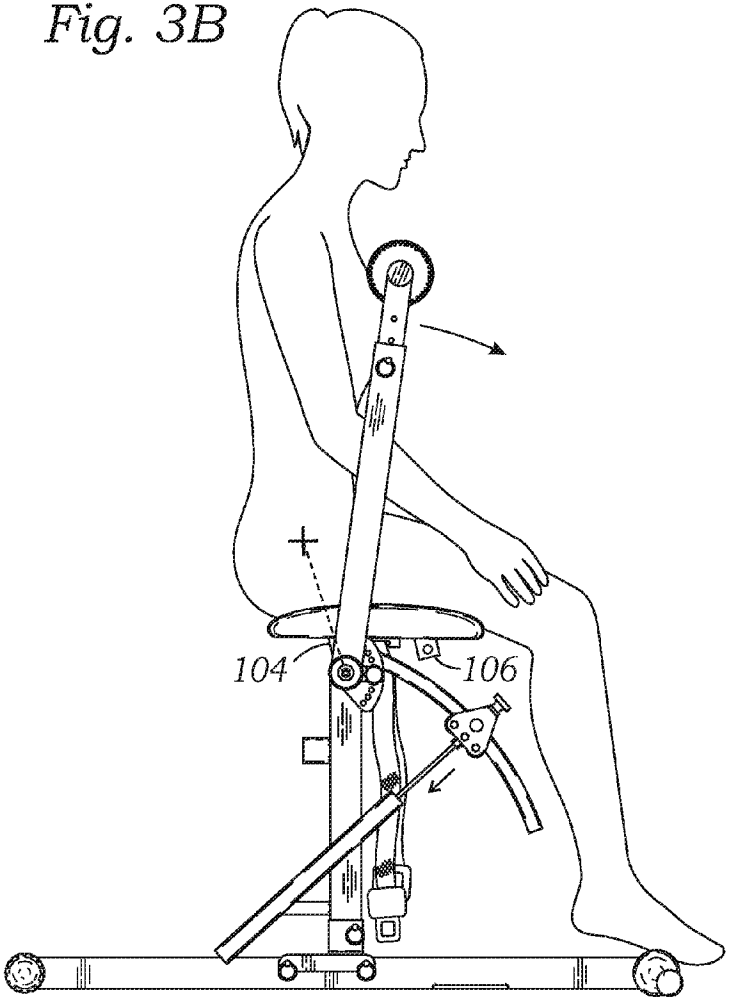
FIGS. 3A and 3B are side elevational views of the exercise machine with a user shown operating the machine in two different modes.
Figure 3A:
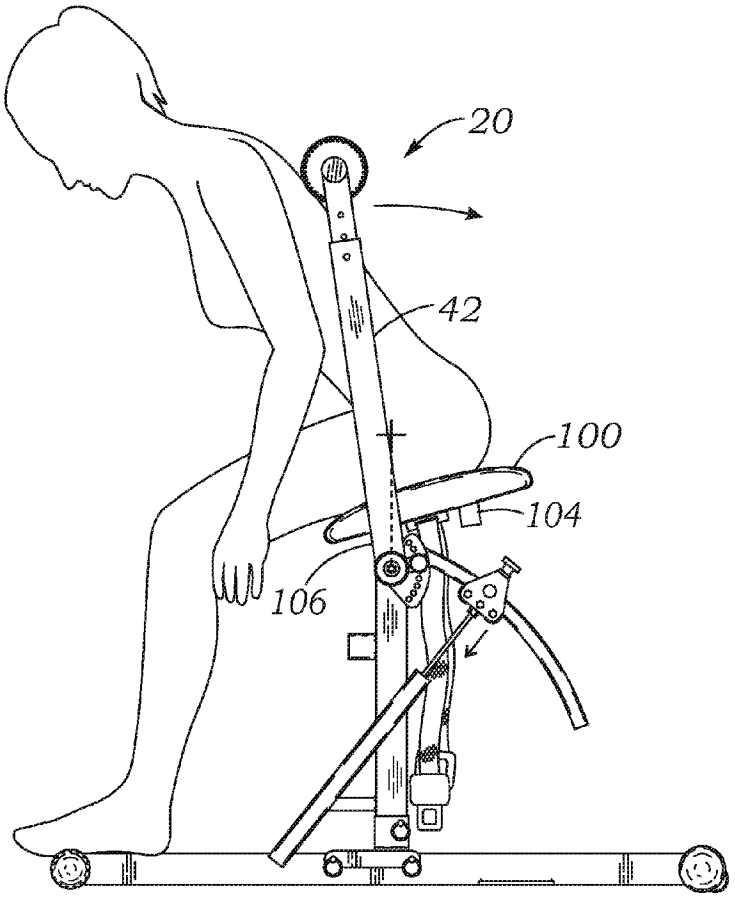

FIGS. 3A and 3B show the exercise machine 20 with a user operating the machine in two different training modes—back extension (erector spinae muscles) and flexion (abdominal muscles). For strengthening the oblique muscles the positioning is the same as in FIG. 3B for the rectus abdominus, but the user turns his/her body at an angle between 0-90 degrees. The user switches between the two primary modes of operation by moving a seat 100 into two different positions over the fixed housing 60 in order to displace the axis of rotation of the user's hips in relationship to the machine's axis of rotation. FIGS. 3A and 3B indicate the different centers of hip rotation, the former essentially directly above the centerline C/L of the horizontal bar 40 and the latter shifted horizontally to one side. This conversion enables a more biomechanically correct position when strengthening the abdominal and erector spinae muscles. Although not shown in FIGS. 3A and 3B, a seat belt 101 (FIG. 2) fixed under the seat 100 may be provided and utilized in either exercise mode to help isolate the targeted muscles and prevent the recruitment of undesired muscles.

Figure 4B:
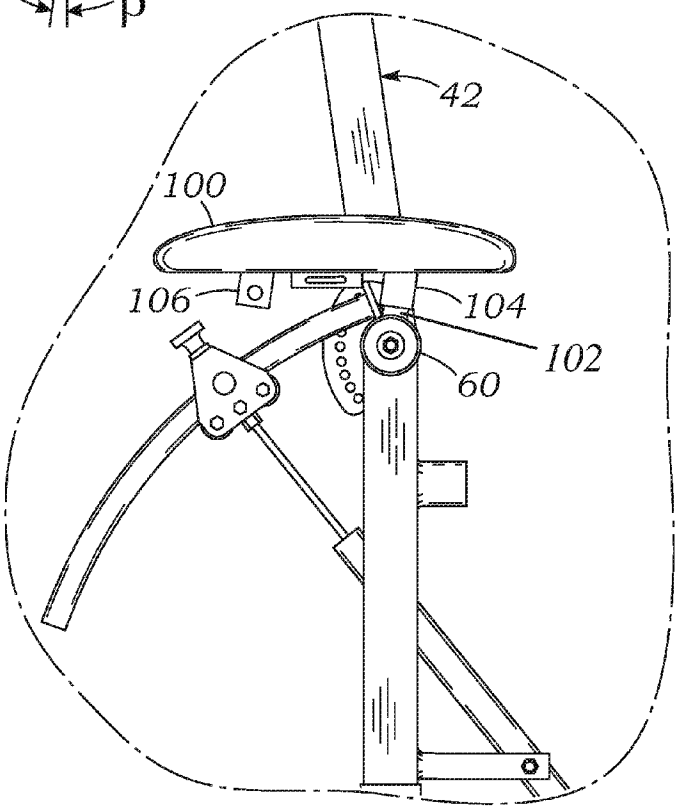
Figure 4C:
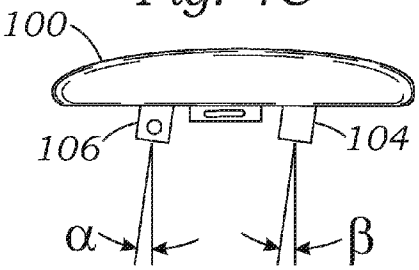
FIG. 4C shows the seat isolated and the angles of two lower mounting tubes.
Figure 4A:
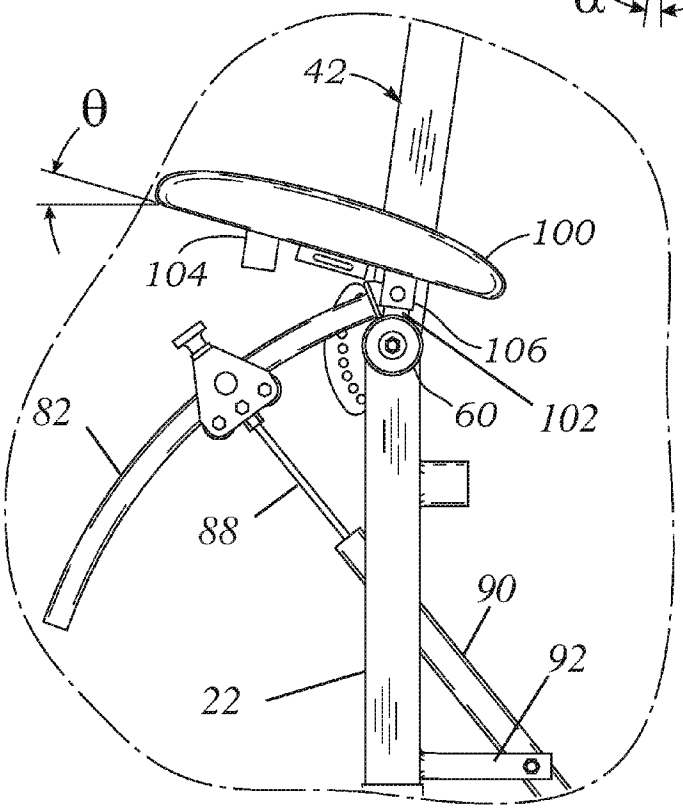

FIG. 1A and also FIGS. 4A and 4B (looking from the direction opposite to FIGS. 3A and 3B) show a short square post 102 welded to the fixed housing 60 at a slight angle to the vertical, preferably between about 5-15°, and more preferably about 8°. FIG. 4C shows the seat 100 isolated and two square mounting tubes 104, 106 projecting downward therefrom at angles from the vertical, $\alpha$ and $\beta$, which are preferably the same ($\alpha=\beta$). In FIGS. 3A and 4A a first mounting tube 106 engages the square post 102 such that the seat 100 assumes an angle $\theta$ with the horizontal, which is preferred for the back extension exercises. The angle $\theta$ is desirably between about 15-20°, and more preferably is about 16°. Conversely, as seen in FIGS. 3B and 4B, the second mounting tube 104 engages the square post 102. In this configuration, the seat 100 is horizontal, or within about 5° of horizontal, which is preferred for the abdominal exercises. Therefore, the angle $\beta$ is approximately the same as the angle at which the square post 102 extends up, which is between about 5-15°, and more preferably about 8°. Also, the angle $\alpha$ plus the angle at which the square post 102 extends upward (preferably about 8°) together make up the angle $\theta$ that the seat makes in the back extension position. Therefore, since in the preferred embodiment the angles $\alpha=\beta$, and $\beta$ is preferably about 8°, in a preferred embodiment the angle $\theta$ equals about 16°.

Figure 5:
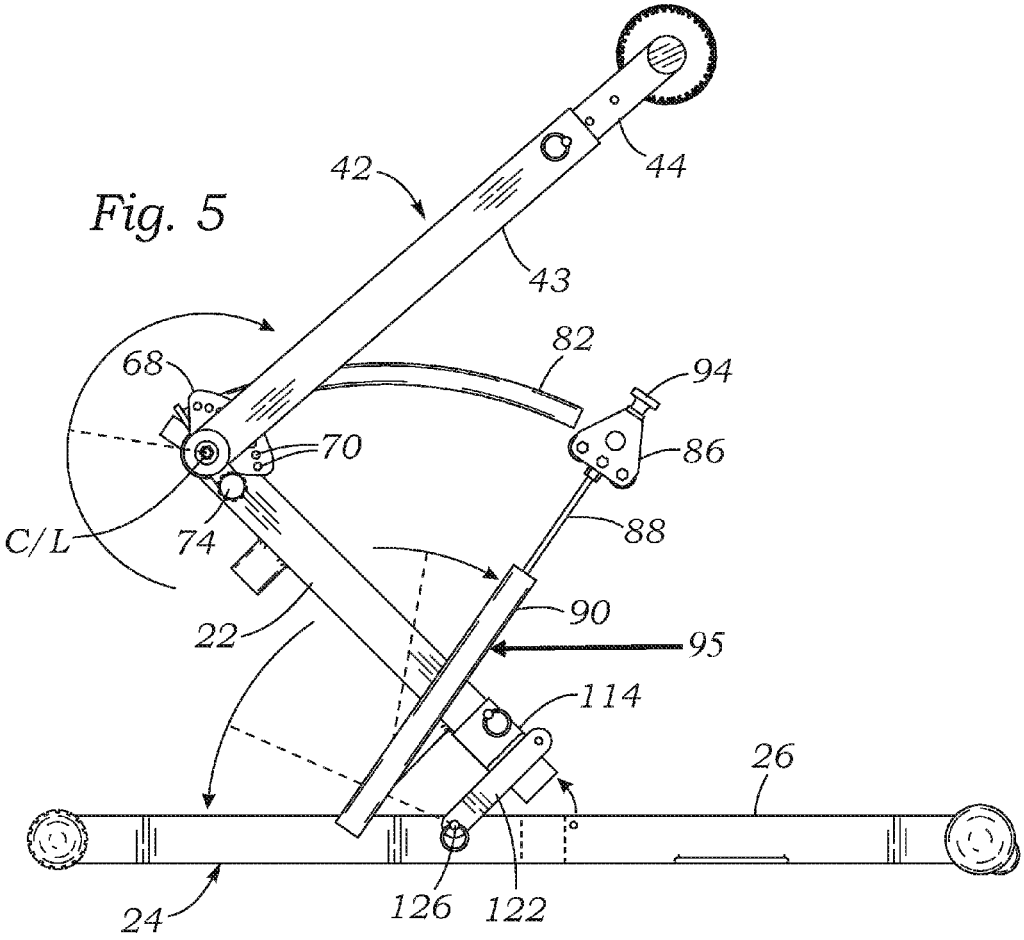
FIG. 5 shows the exemplary exercise machine partly collapsed.
Figure 6:
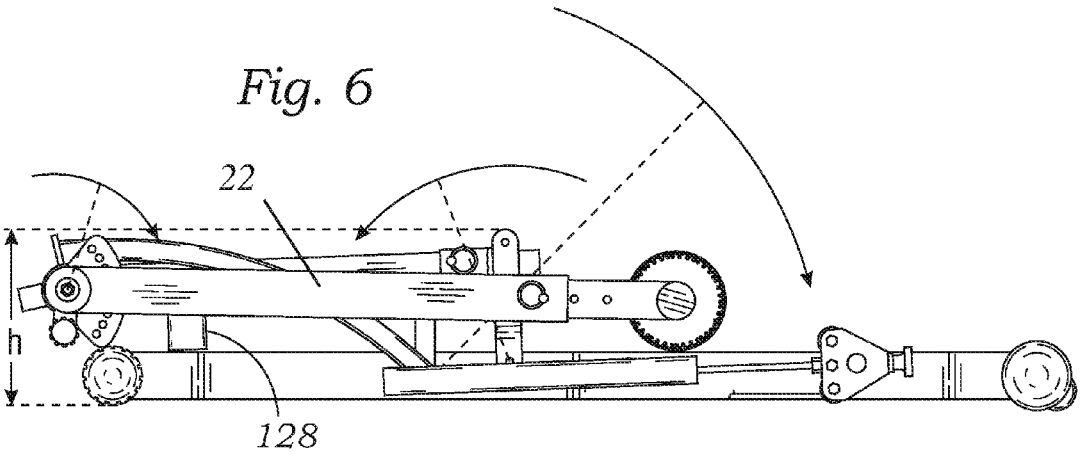
FIG. 6 shows the exercise machine fully collapsed.

FIG. 5 shows the exemplary exercise machine 20 partly collapsed, and FIG. 6 shows the exercise machine fully collapsed. Collapsed, the exercise machine 20 will be no more than 8" tall and preferably 7" or less, and thus will be able to fit under most beds. The lever arm 42 can be rotated to lie substantially horizontally by disengaging the spring-mounted adjustment pin 74 from the adjustment holes 70 in the indexing plate 68. Also, the gas spring 95 can be pivoted down to horizontal about its lower pivot point by disengaging the spring-loaded adjustment pin 94 in the bracket 86 from the adjustment holes 84 in the curved bar 82. Collapse of the upper components of the machine 20 over the base 24 is explained below.

Figure 7B:
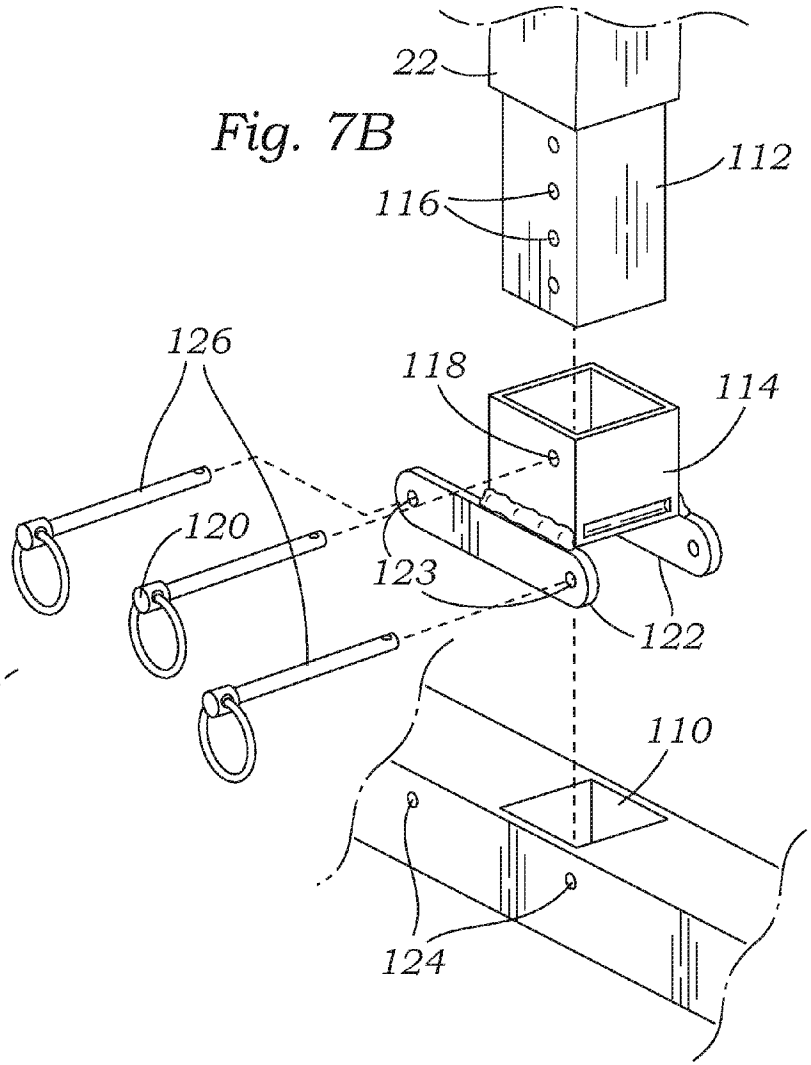
FIGS. 7A and 7B are assembled and exploded views, respectively, of a lower height adjustment configuration.
Figure 7A:
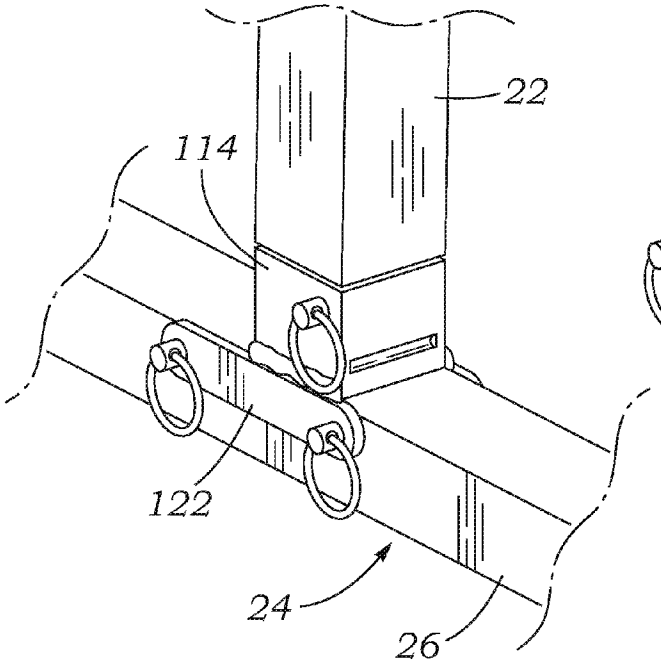

Advantageously, the exercise machine 20 can be adjusted to the leg height of the user to allow for optimum biomechanics and reduce the risk of injury. FIGS. 7A and 7B are assembled and exploded views, respectively, of a lower height adjustment assembly. The vertical leg 22 is supported on and by the central longitudinal bar 26 of the base 24. An upwardly-opening square hole 110 is formed in the middle of the bar 26 into which fits a reduced-size lower end section 112 of the vertical leg 22. The end section 112 has a reduced size relative to the rest of the leg 22 and passes through a height adjustment collar 114 positioned just above the bar 26. The end section 112 has a series of vertically-spaced holes 116 that register with a single hole 118 in the collar 114 such that a pin 120 can fix their relative positions. Removing the pin 120 and shifting the vertical leg 22 up or down enables adjustment of the height of the components of the machine 20 above the base 24. This enables adjustment of the height of the seat 100 for different sizes of users, and also maintains the relative position between the seat 100 and the centerline C/L of the horizontal bar 40, which allows for optimum biomechanics, as seen in FIG. 2. This enables height adjustment without lengthening the lever arm and altering the resistance profile. Desirably, the height of the upper frame can be adjusted at least about 2 inches, and more preferably between 2-4 inches.

For the purpose of collapsing the machine 20, the vertical leg 22 is easily disengaged from the base 24 by virtue of the adjustment collar 114. More specifically, the collar 114 has a pair of longitudinal flanges 122 spaced apart about the same lateral width as the lower base bar 26, and flanking the same. Holes 123 in the flanges 122 line up with holes 124 in the bar 26, and pins 126 extend through both flanges and the bar to secure the collar 114 in place. During collapse of the machine 20, the pin 126 closest to the square hole 110 is removed allowing the upper structure to rotate about the other pin, as seen in FIG. 5. Eventually, the vertical leg 22 rotates to lie substantially horizontally over the lower bar 26, as seen in FIG. 6. A small bumper or spacer 128 attaches to the leg 22 and extends horizontally in the direction opposite the gas spring mechanism. The spacer 128 contacts the base bar 26 when the machine collapses and the distance the spacer juts out from the leg 22 is sufficient to prevent contact between components of the horizontal bar 40 and the base 24, as well as maintaining the generally horizontal low-profile orientation of the leg 22 when collapsed down. The spacer 128 is desirably elastomeric to reduce the noise when collapsing the structure and also to prevent marring the base bar 26.

Once the vertical leg 22 lies substantially horizontally over the lower bar 26, the lever arm 42 rotates to lie substantially horizontally as well, as does the gas spring 95, as shown. FIG. 2 illustrates how these components are offset laterally from one another so as to avoid interfering with their respective collapse. The seat belts 101 may be used to wrap around the entire structure to hold the components generally together, or a separate band or strap may be provided for this purpose.

FIGS. 8-11 schematically illustrate an alternative collapsible exercise machine 220 similar to that shown in FIGS. 1-7, but with several small differences. The exercise machine 220 again features an upper frame having a generally vertical leg 222 supported on and by a horizontal H-shaped base 224. The upper frame includes an adjustable lever arm 242 that is mounted to rotate with a horizontal bar (not shown) as described above. The angle of the lever arm 242 can be adjusted by moving a pin 244 between an array of holes 246 provided in an indexing plate 248 (see FIG. 8B). A horizontal force application bar 250 preferably covered with a foam pad 252 attaches firmly to the top of the lever arm 242 and extends laterally back over the horizontal bar and over a seat 254, preferably as far as the vertical leg 222. As with the first embodiment, a user can rotate the force application bar 250 and lever arm 242 about an axis centered along the horizontal bar. The center line C/L of the horizontal bar 240 defines the axis of rotation of the lever arm 242.

The lever arm 242 is rotationally fixed with respect to a force adjustment bar 260 that depends downward below the seat 254 having a plurality of adjustment holes along its length. An upper end of a gas spring 262 fastens to one of the adjusted holes using a pin or nut and bolt 264. A lower end of the gas spring 262 is pivotally connected via a pin or nut and bolt 266 to an upstanding post 268 on the base 224. It can thus be seen the rotation of the lever arm 242 causes rotation of the force adjustment bar 260, and the amount of resistance force imparted by the gas spring 262 depends on where the spring is connected along the bar.

Figure 8A:
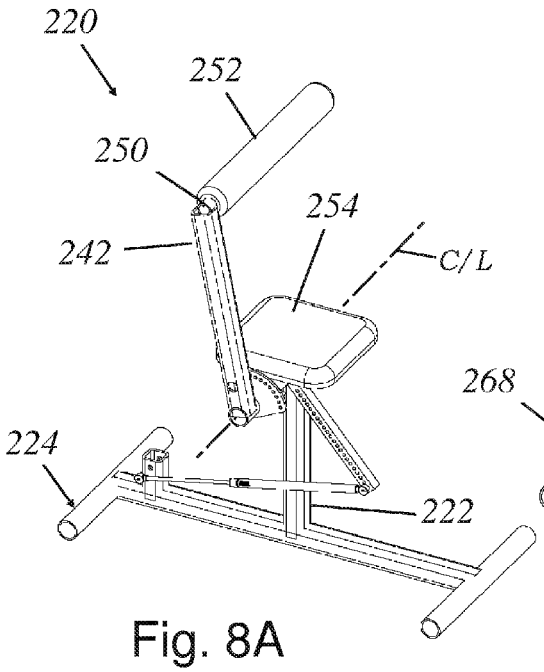
FIGS. 8A and 8B are perspective and side elevational views, respectively, of an alternative exercise machine similar to that shown in FIGS. 1-7 and illustrating the gas spring attached to an adjustment bar so as to produce relatively high force resistance.
Figure 8B:
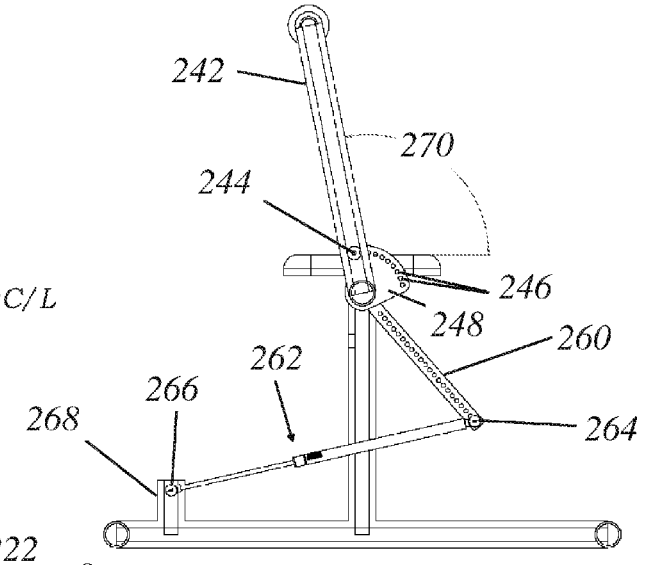
Figure 9A:
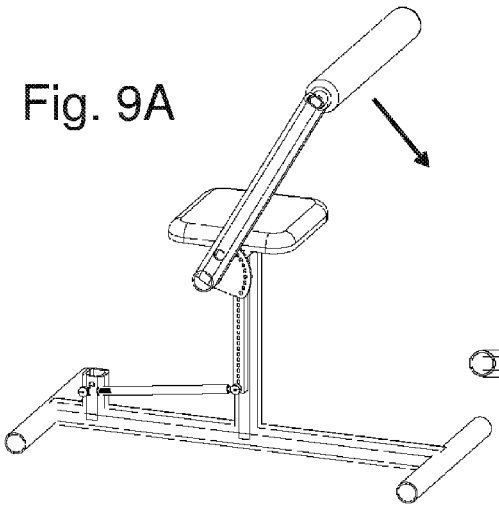
FIGS. 9A and 9B again illustrate the alternative exercise machine with the gas spring attached so as to produce relatively high force resistance and a lever arm rotated to a different angle for a different exercise.
Figure 9B:
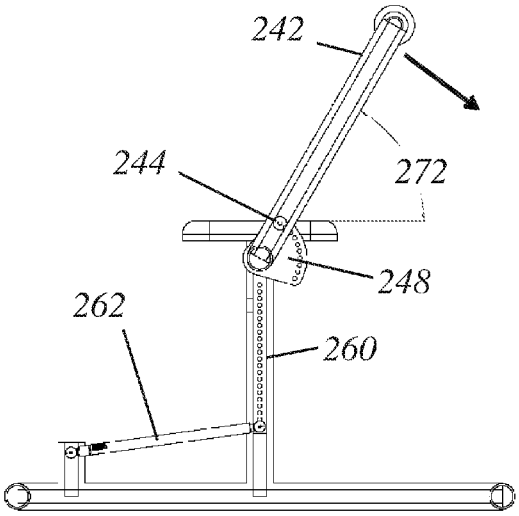
Figure 10A:
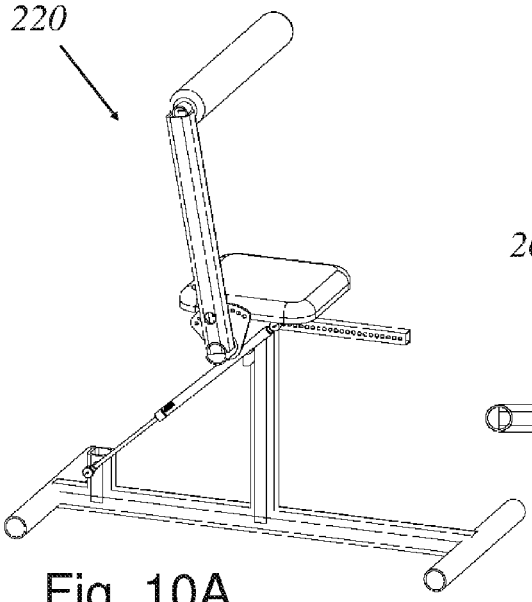
FIGS. 10A and 10B again show the alternative exercise machine with the gas spring attached so as to produce relatively low force resistance.
Figure 10B:
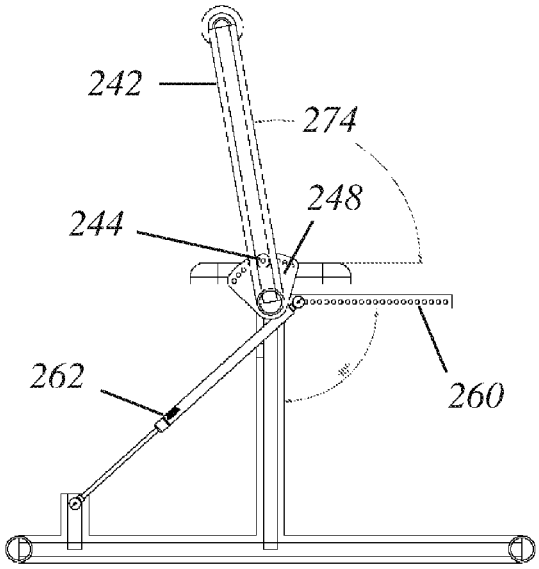

FIGS. 8A and 8B illustrate the gas spring 262 attached to the distal end of the adjustment bar 260 so as to produce relatively high force resistance. Furthermore, the pin 244 is placed in one of the holes 246 in the indexing plate 248 so as to maximize the angle between the lever arm 242 and the force adjustment bar 260. The lever arm 242 is adjusted to an obtuse angle 270 from the horizontal, so the user can sit on the seat 254 and perform back extension (erector spinae muscles) or flexion (abdominal muscles) exercises. FIGS. 9A and 9B illustrate the same configuration after the lever arm 242 is rotated to an acute angle 272, thus fully compressing the gas spring 262. The reader will understand that repositioning the lever arm 242 in a clockwise direction relative to the indexing plate 248 will increase the user's leverage and reduce the amount of force needed to rotate the lever arm 242. Likewise, moving the upper end of the gas spring 262 along the adjustment bar 260 toward its axis of rotation (the same as the center line C/L) will reduce the moment arm and increase leverage.

Figure 11A:
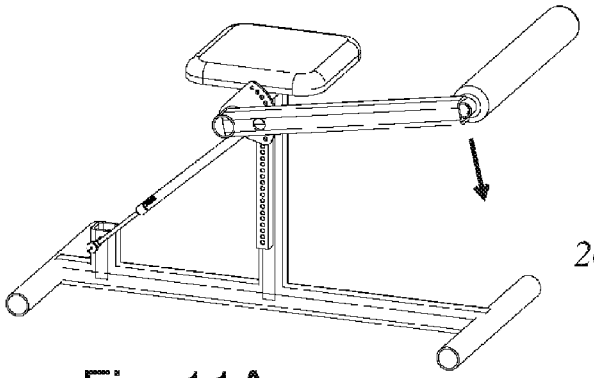
FIGS. 11A and 11B show the alternative exercise machine with the gas spring attached to produce relatively low force resistance and the lever arm rotated to a nearly horizontal position.
Figure 11B:
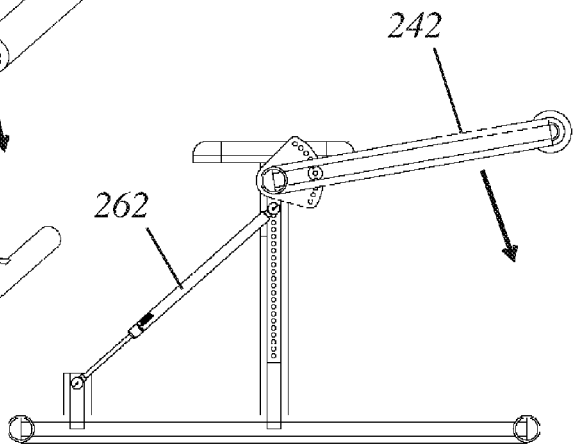

FIGS. 10A and 10B again show the alternative exercise machine 220 with the gas spring 262 attached so as to produce greater leverage and relatively low force resistance. More particularly, the upper end of the gas spring 262 pivotally attaches to a hole in the force adjustment bar 260 closest to its axis of rotation. Also, the pin 244 has been moved clockwise along the holes in the indexing plate 248 to reduce the angle between the lever arm 242 and adjustment bar 260. The lever arm 242 is shown at an obtuse angle 274 to the horizontal in FIG. 11A. After clockwise rotation of the lever arm as seen in FIG. 11B, the gas spring 262 is compressed, though not as far as in FIGS. 9A and 9B.

FIGS. 12-17 illustrate an alternative exercise machine 300 which is a plurality of support legs, in contrast to the single generally vertical leg 22 extending up from the base 24 in the earlier embodiments. Not only will multiple legs increase stability, but as will be shown the exercise machine 300 can easily collapse. Several features described above with regard to the first embodiment are not shown in the alternative exercise machine 300 for clarity, though such features could easily be included.

Figure 12B:
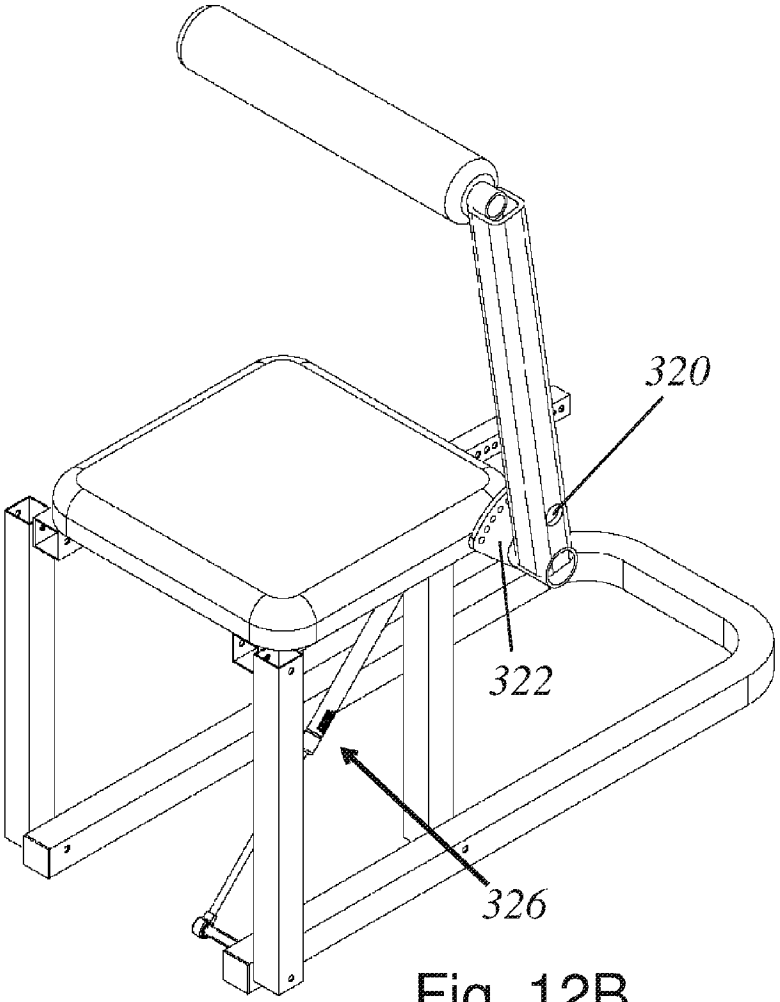
FIGS. 12A and 12B are perspective views of a still further alternative collapsible exercise machine in accordance with the present invention wherein the seat and lever arm are supported by multiple legs.
Figure 12A:
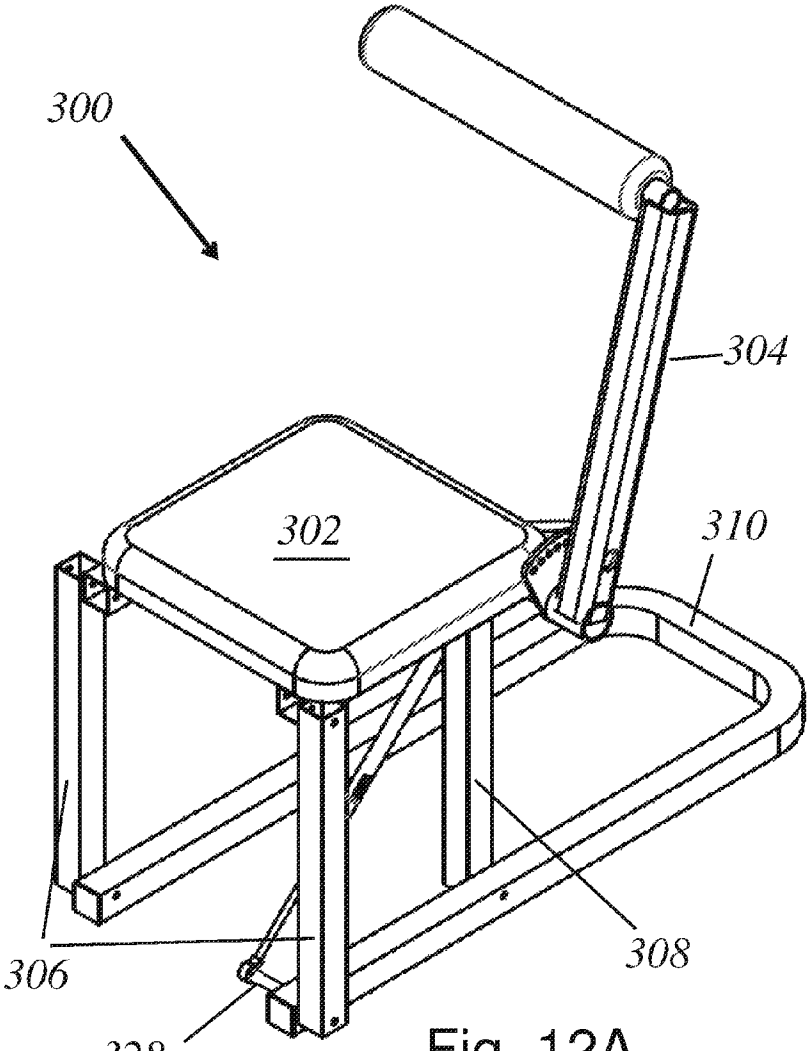

FIGS. 12A and 12B are perspective views of the exercise machine 300 wherein a seat 302 and lever arm 304 are supported by multiple legs 306, 308 over a base 310. The base 310 includes a generally U-shaped member and two of the support legs 306 are pivotally mounted outside of the free ends thereof. The other two support legs 308 are pivotally mounted inside of the U-shaped base 310 and approximately halfway to the closed end thereof. As seen also in FIGS. 13A-13D, upper ends of the legs 306, 308 are pivotally mounted to a generally square frame 312 under the seat 302. Although not shown, the rotational position of each of the legs 306, 308 may be locked with respect to both the base 310 and the frame 312 via locking pins or the like. In the configuration of FIGS. 12-13, the legs 306, 308 are locked at 90° with respect to both the base 310 and the frame 312 such that the exercise machine 300 is in its upright and functional configuration.

The lever arm 304 rotates as described earlier about a horizontal bar (not shown) mounted under one end of the seat 302. The angle of the lever arm 304 with respect to the horizontal bar may be altered by moving a pin 320 within an array of holes in an indexing plate 322. As seen best in FIG. 13A, a force adjustment bar 324 depends down from the horizontal bar and has a series of holes therein. An upper end of a gas spring 326 pivotally attaches to one of the holes using a pin or nut and bolt combination. A lower end of the gas spring 326 pivotally attaches to a lower front corner of the base 310, such as via a pivot rod 328 as seen in FIGS. 12A and 12B. Aside from the multiple legs 306, 308, the exercise machine 300 functions much like the earlier embodiment, wherein the amount of force may be adjusted as well as the angle of the lever arm 304.

Figure 14B:
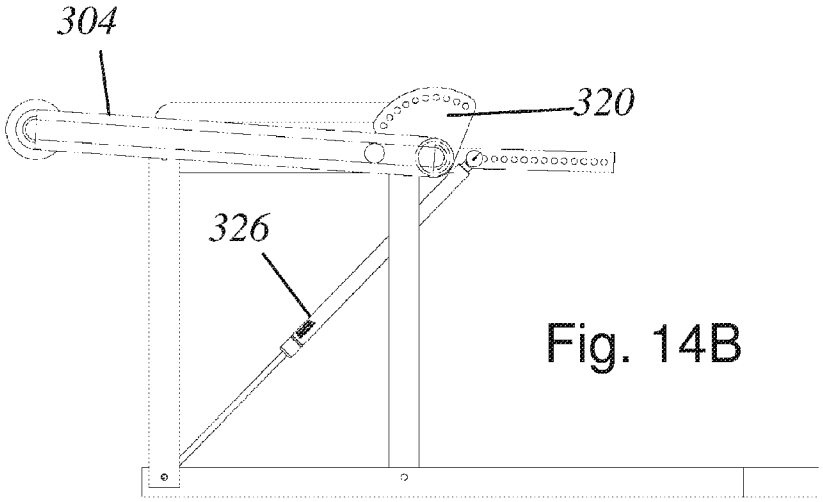
FIGS. 14A-14C are side elevational views of the multi-leg exercise machine showing three steps preliminary to collapse thereof.
Figure 14C:
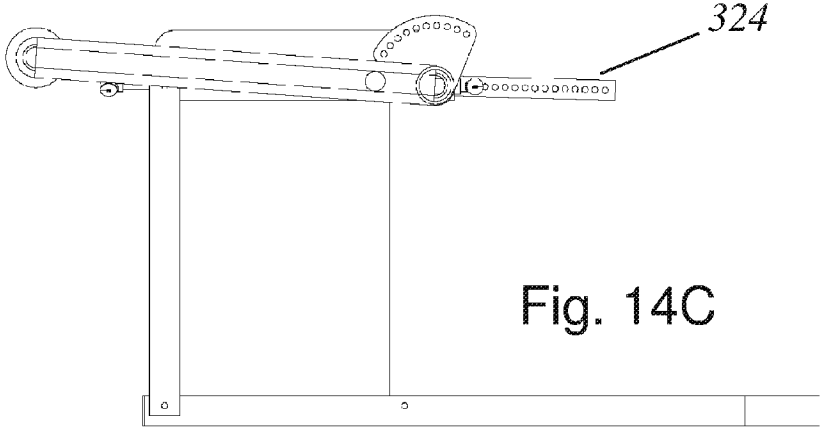
Figure 14A:
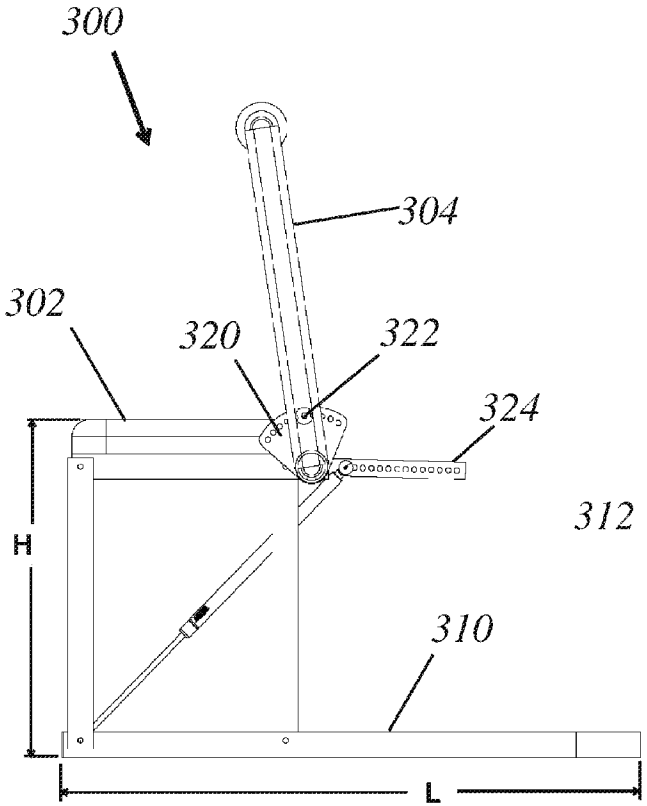

FIG. 14A illustrates an exemplary height H from the ground to the seat 302. In a preferred embodiment, the height H is between 18-22 inches (45-56 cm), more preferably about 20 inches (50 cm). The length L of the frame 310 is between about 30-36 inches (76-91 cm), and more preferably about 34 inches (86 cm).

FIGS. 14B-14C are side elevational views of the multi-leg exercise machine 300 showing three steps preliminary to collapse thereof. First, the lever arm 304 is decoupled from the force resistance assembly by removing the pin 320 from the indexing plate 322, as seen in FIG. 14B. The lower end of the gas spring 326 is then detached from its pivot rod 328 (FIG. 12A) and both the lever arm 304 and gas spring are aligned horizontally, as in FIG. 14C. Note the force adjustment bar 324 projecting out from under the seat 302.

Figure 15A:
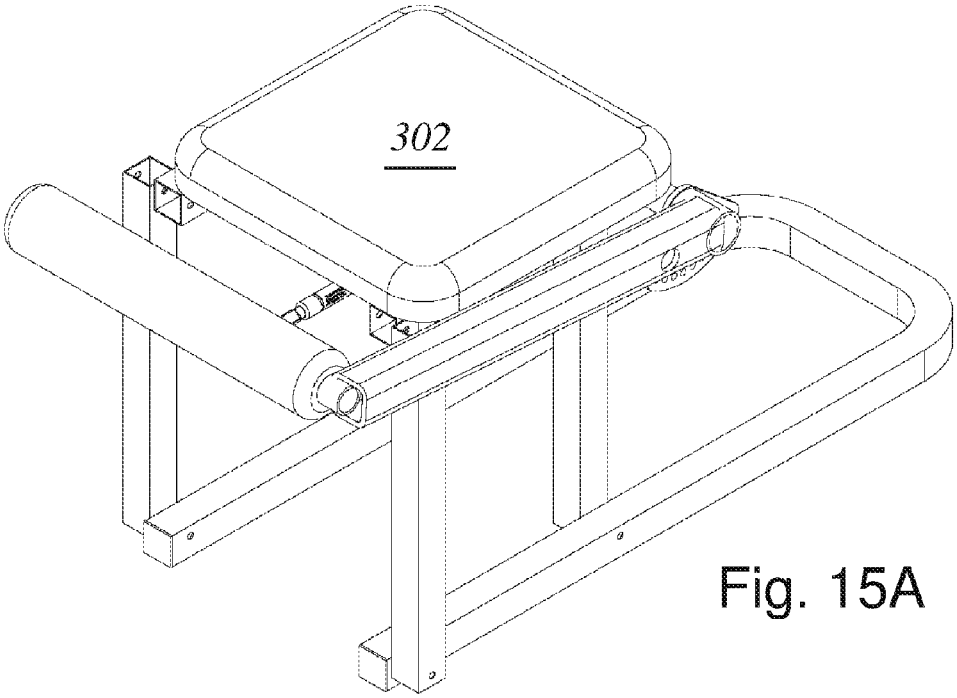
FIGS. 15A and 15B are perspective and elevational views of the multi-leg exercise machine after rotation of a lever arm indexing plate preparatory to collapse.
Figure 15B:
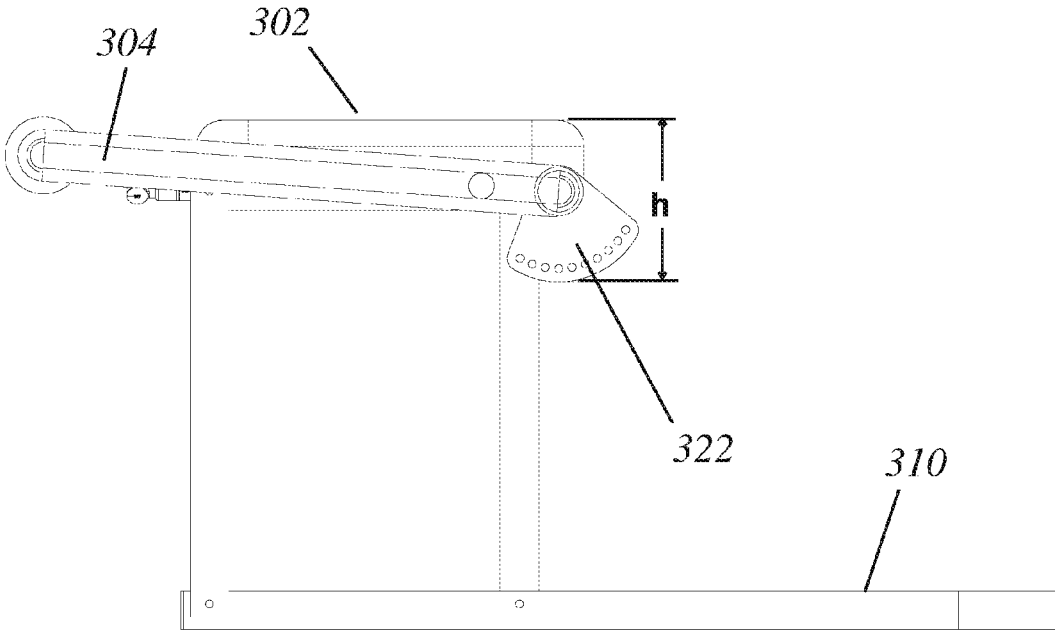

Next, as seen in FIGS. 15A and 15B, the force adjustment bar 324 is rotated about 180° underneath the seat 302. By virtue of the fixed nature of the force assembly, this also rotates the indexing plate 322 from above to below the lever arm 304. FIG. 15B shows an exemplary dimension of the height h from the top of the seat 302 to the lower edge of the indexing plate 322. As will be seen, this height h defines the height to which the exercise machine 300 can be collapsed, and is desirably less than 8 inches (20 cm), and more preferably less than 7 inches (18 cm). In one embodiment, the height h is about 6.25 inches (16 cm).

Figure 16A:
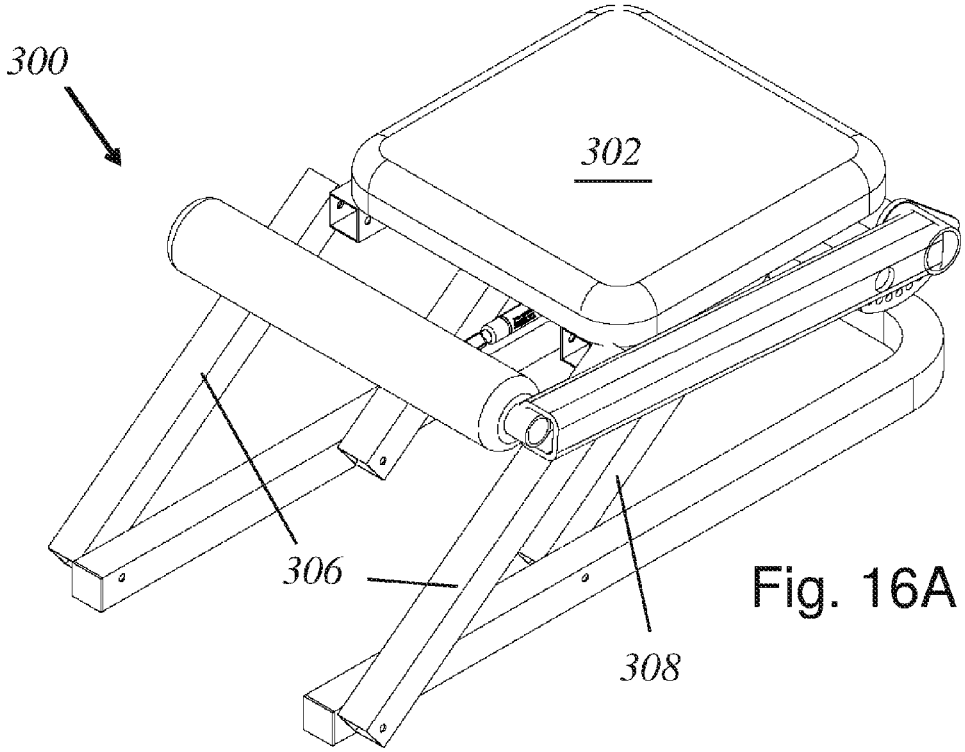
FIGS. 16A and 16B are perspective and elevational views of the multi-leg exercise machine in a state of partial collapse.
Figure 16B:
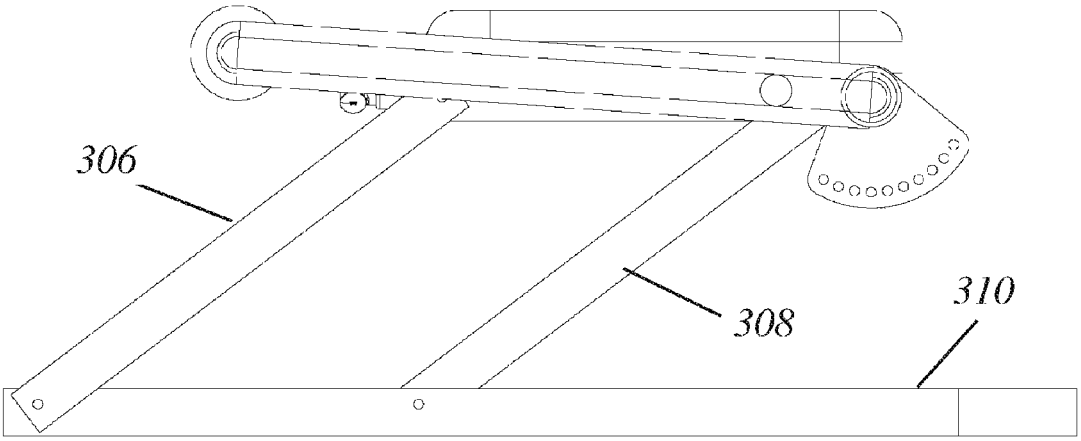

FIGS. 16A and 16B are perspective and elevational views of the multi-leg exercise machine 300 in a state of partial collapse. The pivot points at the top and bottom of each leg 306, 308 are unlocked to enable this collapse. The outer legs 306 fold down on the outside of the frame 310, and the inner legs 308 fold down on the inside thereof.

Figure 13B:
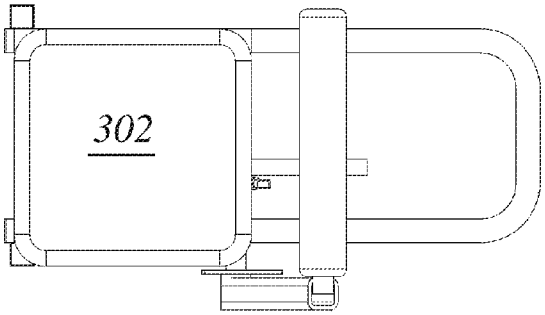
FIGS. 13A-13D are orthogonal views of the multi-leg exercise machine of FIGS. 12A and 12B.
Figure 13A:
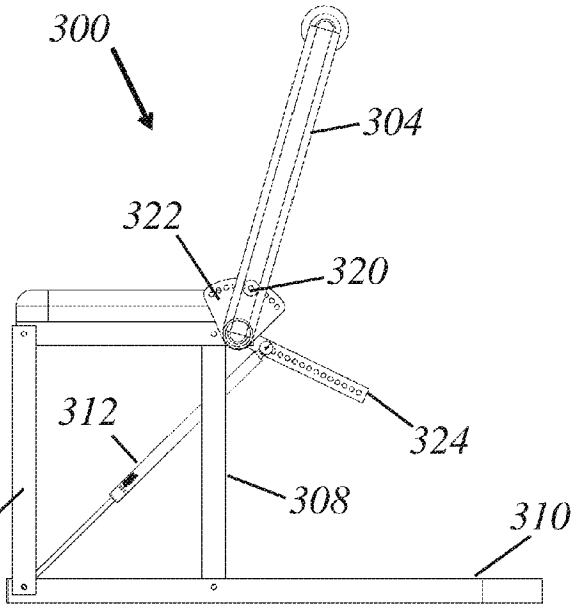
Figure 13C:
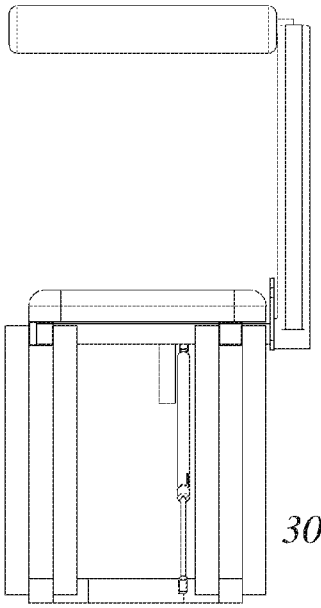
Figure 13D:
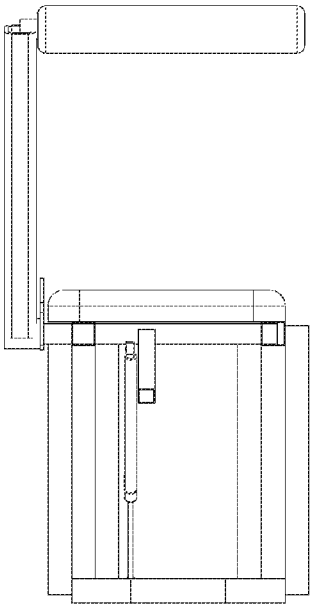

Finally, FIGS. 17A-17C show the fully collapsed multi-leg exercise machine 300. Again, by virtue of the laterally offset positions of the various components, as seen in FIG. 13C and 13D, they all fold down to lie in essentially the same plane. A strap or bag may be provided to prevent the assembly from opening up, or the locking mechanism at the top and bottom of each leg 306, 308 may also secure them in their collapsed configuration.

Although the invention has been described and illustrated with a certain degree of particularity, it is understood that the present disclosure has been made only by way of example, and that numerous changes in the combination and arrangement of parts can be resorted to by those skilled in the art without departing from the scope of the invention, as hereinafter claimed.

What is claimed is:

1. An exercise machine, comprising:

a base;

a plurality of legs, wherein the legs have a lockable operating position that is fixed relative to the base and in which the legs are substantially parallel to one another, and wherein the legs are configured to rotate relative to the base to lie substantially flat and collapse the machine;

a seat mounted on the top of each of the legs such that a user can sit on the seat with his or her legs on the ground or on the base;

a horizontal bar;

a housing fixed at the top of one of the vertical legs and adjacent the seat, wherein the horizontal bar is configured to rotate within the housing;

a vertically oriented lever arm attached at one of its ends to the horizontal bar;

a horizontal force application bar fixed to the lever arm at the end opposite the horizontal bar, configured such that force applied to the force application bar by a user on the seat results in rotation of the horizontal bar within the housing;

a gas spring to provide resistance to rotation of the horizontal bar; and an adjustable indexing device connected to the lever arm for adjusting the rotational orientation of the lever arm relative to the housing.

2. The machine of claim 1, further comprising:

an adjustment pin fixed to the lever arm; and a plurality of indexing holes in the adjustable indexing plate, wherein the adjustable indexing device is an adjustable indexing plate and is fixed to the housing near the lever arm and projects radially away from the housing, and then adjustment pin is configured to fit into one of the indexing holes to set the rotational orientation of the lever arm relative to the housing.

3. The machine of claim 1, wherein the machine is configured to collapse by disengaging the adjustable indexing device.

4. The machine of claim 1, further comprising a force adjustment bar extending from the horizontal bar, wherein the gas spring is connected at its lower end to the vertical leg on which the housing is fixed and at its upper end to the force adjustment bar, and wherein the position of the upper end of the gas spring is adjustable along the force adjustment bar.

5. The machine of claim 1, wherein the progressivity of the gas spring is 10% or less.

6. The machine of claim 1, wherein the vertical legs are lockable in the collapsed position.

* * * * *